US005382875A

United States Patent [19]

Grocki et al.

[11] Patent Number: 5,382,875

[45] Date of Patent: Jan. 17, 1995

[54] STRAY MAGNETIC FIELD SUPPRESSER FOR CRT IMAGE DISPLAYS

[75] Inventors: Wayne D. Grocki, Libertyville; Christopher S. DeWaal, Oak Park, both of Ill.

[73] Assignee: Zenith Electronics Corporation, Glenview, Ill.

[21] Appl. No.: 927,705

[22] Filed: Aug. 10, 1992

[51] Int. Cl.[6] ..... H01J 29/06

[52] U.S. Cl. ..... 315/8; 335/214; 335/301; 335/304; 335/211; 313/430

[58] Field of Search ..... 315/8; 313/430; 335/214, 301, 304, 211

[56] References Cited

U.S. PATENT DOCUMENTS

| | | | |
|---|---|---|---|
| 4,153,858 | 5/1979 | Schylander | 315/8 |
| 4,709,220 | 11/1987 | Sakane et al. | 335/214 |
| 4,864,192 | 9/1989 | Buchwald et al. | 315/8 |
| 4,950,955 | 8/1990 | Hoover et al. | 315/8 |
| 5,073,744 | 12/1991 | Buhler | 315/8 |
| 5,198,729 | 3/1993 | Powell | 315/8 X |

OTHER PUBLICATIONS

"Test-Methods for Visual Display Units: Vixual Ergonomics and Emission Characteristics" MPR 1990:8 1990-1991, Boras, Sweden Copy consists of selected excerpts concerning magnetic fields.

*Primary Examiner*—Robert J. Pascal
*Assistant Examiner*—Reginald A. Ratliff

[57] ABSTRACT

A stray magnetic field suppression system for use in a CRT image display suppresses a stray magnetic field that emanates from the horizontal deflection coil of a beam-deflecting yoke which is energized by sawtooth waveform pulses from a horizontal oscillator. The system comprises two series-connected magnetic coil assemblies in conjunction with a capacitor and activated by the sawtooth waveform pulses. The capacitor serves to integrate the pulses, enabling the suppression system to form an effective field for suppressing a stray magnetic field when the magnetic coil assemblies are interposed in the path of the stray magnetic field on opposite sides of the yoke.

13 Claims, 4 Drawing Sheets

STRAY MAGNETIC FIELD SUPPRESSER FOR CRT IMAGE DISPLAYS

CROSS-REFERENCE TO RELATED APPLICATIONS

This application is related to but in no way dependent on copending applications Ser. No. 07/868,922 now U.S. Pat. No. 5,231,322 filed Apr. 15, 1992, Ser. No. 07/814,125 now U.S. Pat. No 5,208,510 filed Dec. 30, 1991, and Ser. No. 07/998,092 filed Dec. 28, 1992, of common ownership herewith.

BACKGROUND OF THE INVENTION

This invention relates to cathode ray tube image displays, hereafter simply called "CRT's," and is addressed to means for suppressing stray magnetic fields emitted by such systems. More particularly, the objective is to suppress such emissions to a level below that established by a recognized standard. The invention is applicable to both monochrome and color CRT image displays in which the viewer may be in close proximity to the faceplate, such as the viewers of visual display terminals and television sets.

The present invention had its origin in the concern over the possible detrimental effects of stray magnetic fields on the physiology of the viewers. Testing for such fields in visual display terminals is described in a publication of the National Board for Measurement and Testing (MPR) of Sweden entitled "Test Methods for Visual Display Units: Visual Ergonomics and Emission Characteristics." MPR 1990:8 1990–1991, Boras, Sweden. This standard is known as "MPR-2." The subject of stray magnetic fields is also covered by the IEEE Transactions on Electromagnetic Compatibility, a periodic publication of the IEEE Electromagnetic Compatibility Society.

As is known, the primary source of stray magnetic fields in CRT's is the yoke. The yoke is an electromagnetic device that causes an electron beam to scan a raster on the CRT viewing screen in both the horizontal and vertical directions. Monochrome CRT's utilize a single electron beam. CRT's displaying color images typically utilize three beams, one for energizing each of the red, green and blue light-emitting phosphors on the viewing screen. In this disclosure, reference is made to only a single beam CRT, with the understanding that its content applies as well to multiple-beam CRT's.

Essentially, a yoke consists of two pairs of coils, one of which deflects the electron beam in the horizontal direction, and the other in the vertical direction. The two pairs of coils appear as dual radiating magnetic dipoles. The present invention is directed to the suppression of stray magnetic fields produced by the horizontal deflection yoke coils.

The coils are energized by a horizontal oscillator and a vertical oscillator. The horizontal oscillator provides a train of pulses having a frequency of 15,750 Hz in monochrome television sets, a frequency of 15,734.26 Hz in color television sets, and frequencies of up to 150 kHz in some visual display terminals. The pulses are routed to the horizontal winding of the yoke.

FIG. 1A depicts the general configuration of the sawtooth waveform pulse emitted by a horizontal oscillator. The activation of prior art stray magnetic field suppression devices has been accomplished by the inverted sawtooth waveform pulse indicated in FIG. 1B, which is essentially a mirror-image of the horizontal oscillator waveform of FIG. 1A. The inverted pulse depicted is used to energize prior art stray field suppression devices such as the device disclosed in U.S. Pat. No. 4,709,220 to Sakane et al.

Known solutions to the problem of suppressing stray magnetic fields typically involve some shielding combined with field cancellation techniques. The techniques have taken the form of additional field generating coils in series connection with the horizontal deflection windings of the yoke. The disadvantage of this approach is that higher pulse voltages are required to drive the windings. As a result, a major redesign of the circuits of the horizontal oscillator and the power supplies has been required.

The stray magnetic field that emanates from the beam-deflecting yoke of CRT is depicted diagrammatically in FIG. 2. A CRT 10 is enclosed in a cabinet 12. A beam-deflecting yoke 14 is indicated as encircling the neck 16 of CRT 10. By the variance of its magnetic fields, yoke 14 provides for the horizontal and vertical deflection of an electron beam emitted by an electron gun 18 that is enclosed in neck 16 of CRT 10.

The stray magnetic field that emanates from the horizontal deflection coil of the yoke 14 is indicated as being composed of two loops, a first loop 22 and a second loop 24, both of which extend beyond the perimeter of the cabinet 12. The clockwise direction of the stray magnetic field indicated by first loop 22 that extends into the frontal area 26 of cabinet 12 is indicated by arrows 28 and 30. The counter-clockwise direction of the stray magnetic field indicated by second loop 24 that extends into the rearward area 32 of cabinet 12 is indicated by arrows 34 and 36.

The suppression of the stray magnetic field by a stray field suppression system is indicated diagrammatically in the form of two loops 38 and 40 running in paths opposite to the respective paths of the stray fields indicated by loops 22 and 24. The stray field represented by first loop 22, shown as rotating in a clockwise direction indicated by arrows 28 and 30, is opposed by the third loop 38, in which arrows 41 and 42 indicate that the stray field suppressing third loop 38 lies in a counter-clockwise direction. Similarly, the stray field indicated. by second loop 24 is opposed by the fourth loop 40, and arrows 44 and 46 indicate that the direction of the fourth loop 40 lies in a clockwise direction.

The measurement of the strength of the magnetic field emitted by the yoke 14 of the CRT 10 is indicated in FIGS. 3 and 4. The value measured is the rms (root mean square) of the strength of the field according to the formula for the rms value of periodic waveforms:

$$F_{rms} = \sqrt{\frac{1}{T}\int_0^T [f(t)]^2 dt}$$

FIG. 3 is a three-dimensional view of the three planes of the system along which the field is measured: a top plane 48, a middle plane 50 (also shown by FIGS. 2 and 4) and a bottom plane 52. The distance 54 between the planes is preferably 0.3 meter.

With reference to FIG. 4, measurements are made from the center 54 of the cabinet 12. Center 54 is in coincidence with the horizontal center line 56 of CRT 10. The distance R, or radius, in meters between the center 54 of the cabinet 12 and the perimeter of the three planes 48, 50 and 52 is determined by the formula R=L/2+0.5 m, where L is the front-to-back dimension of the cabinet 12.

FIG. 4 also depicts the points of measurement 58 of the strength of a stray magnetic field on each of the three planes 48, 50 and 52. Measurements on each plane are taken every 22.5 degrees. As sixteen measurements are taken in each plane, the total number of measuring points is forty-eight.

The range of stray field intensity among CRT image displays of various sizes and types was found to be 70 to 150 nT (nanoTesla). Measurements at the measurement points on planes 48, 50 and 52 disclosed a range of 40 to 150 nT. The Swedish MPR-2 standard specifies a maximum of 25 nT. The strength of a stray magnetic field is determined by means of a meter capable of measuring the rms value of low frequency magnetic fields; that is, fields in the frequency range of 2,000 Hz to 400 kHz. The meter must have a dynamic range of 0.01 uT to 10,000 uT. The measurement cycle includes measurement of the strength of stray magnetic field, its frequency and its polarization. A suitable instrument is Magnetic Field Meter 1000 manufactured by Combinova AB, Bromma, Sweden. The United States representative of this company is Ergonomics, Inc., Southhampton, Pa.

A feasible system for the resolution of the problem of stray magnetic fields must provide for stray field suppression well below the established standard, and do so with minimum interference with existing circuits, and with minimum power consumption. Also, the system must be simple and inexpensive to manufacture and install. The present invention meets these and all other requirements.

OBJECTS OF THE INVENTION

It is a general object of the invention to a) suppress stray magnetic fields that emanate from the horizontal windings of the beam-deflecting yoke of CRT image displays.

b) suppress the magnitude of stray magnetic fields to a level well below the maximum limit of 25 nT specified by standard MPR-2.

c) suppress stray magnetic fields without adversely affecting the performance of the yoke or other CRT circuits such as the horizontal oscillator and the power supplies.

d) suppress stray magnetic fields without the need for a major redesign of the horizontal oscillator.

e) suppress stray magnetic fields without the need for additional, costly metallic shields in the CRT cabinet.

f) suppress stray magnetic fields by a system that requires very low power for operation.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

FIG. 15 is a side view of FIG. 14.

DESCRIPTION OF THE PREFERRED EMBODIMENT

Figure 5:
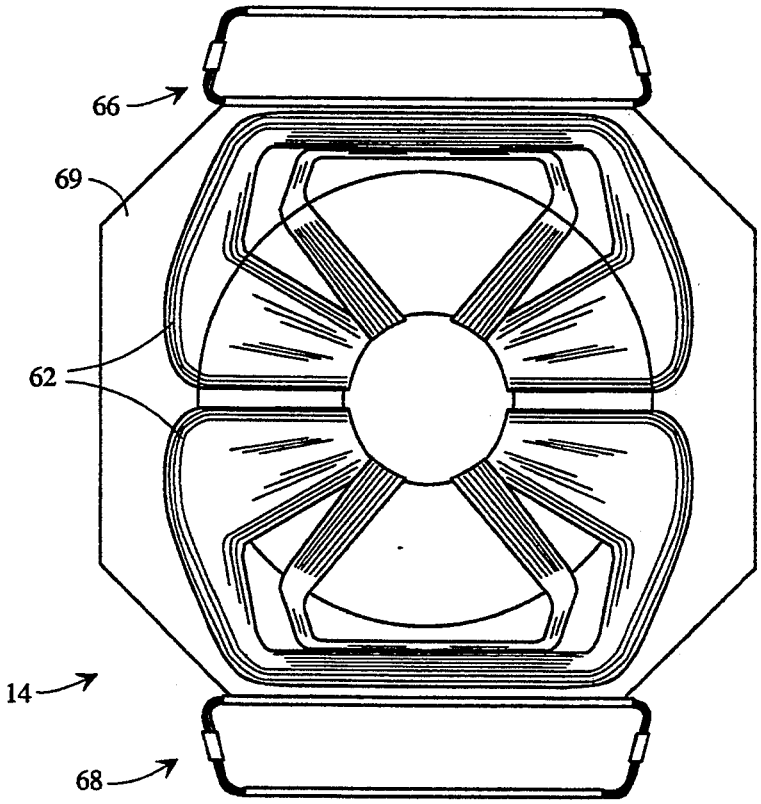
FIG. 5 is view in elevation of a beam-deflecting yoke as seen from the faceplate end of a CRT, with the CRT withdrawn.

FIG. 5 is a depiction of the yoke 14 described heretofore as viewed from the front of the cabinet 12, and with the CRT 10 withdrawn. The yoke 14 comprises electrical windings 62 composed of copper wire wound on a ferrite core, and which magnetically induce deflection of an electron beam. The electrical windings 62 shown induce beam deflection in a horizontal direction; the windings that induce vertical deflection of the beam are not visible.

The electrical windings 62 are energized by a horizontal. oscillator that typically emits a train of positive-going pulses having an amplitude of 400 to 1,000 volts. The pulses are integrated by the yoke circuit into a current having an amplitude in the range of three to twenty amperes for deflection of a beam.

Figure 1A:
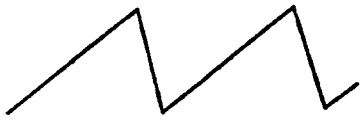
Fig. 1A PRIOR ART
FIG. 1A is a diagram of the sawtooth waveform output of a horizontal oscillator.
Figure 1B:
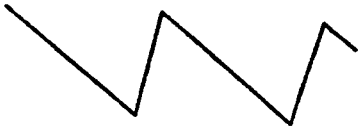
FIG. 1B is a diagram of an inverted waveform that is a mirror image of the waveform depicted in FIG. 1A.
Figure 2:
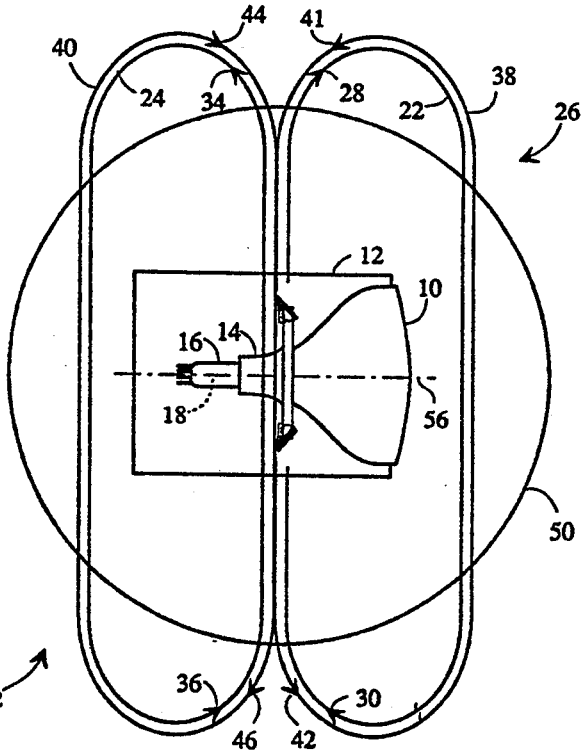
Fig. 2 PRIOR ART
FIG. 2 is a schematic diagram that depicts a cabinet containing a CRT on which a yoke is installed, and indicates the stray magnetic field that emanates from the horizontal deflection coil of the yoke, and the suppression of the stray magnetic field.

Suppression of the stray magnetic fields indicated by first loop 22 and second loop 24 (FIG. 2) is accomplished by a first magnetic coil assembly 66 and second magnetic coil assembly 68, which are components of the stray magnetic field suppression system according to the invention. The magnetic coil assemblies 66 and 68 are shown as affixed to the yoke 14 by means of a yoke support collar 69 which encompasses and extends from yoke 14. Because of their location, the first magnetic coil assembly 66 and the second magnetic coil assembly 68 are interposed in the path of the stray magnetic field on opposite sides of the yoke.

Figure 6:
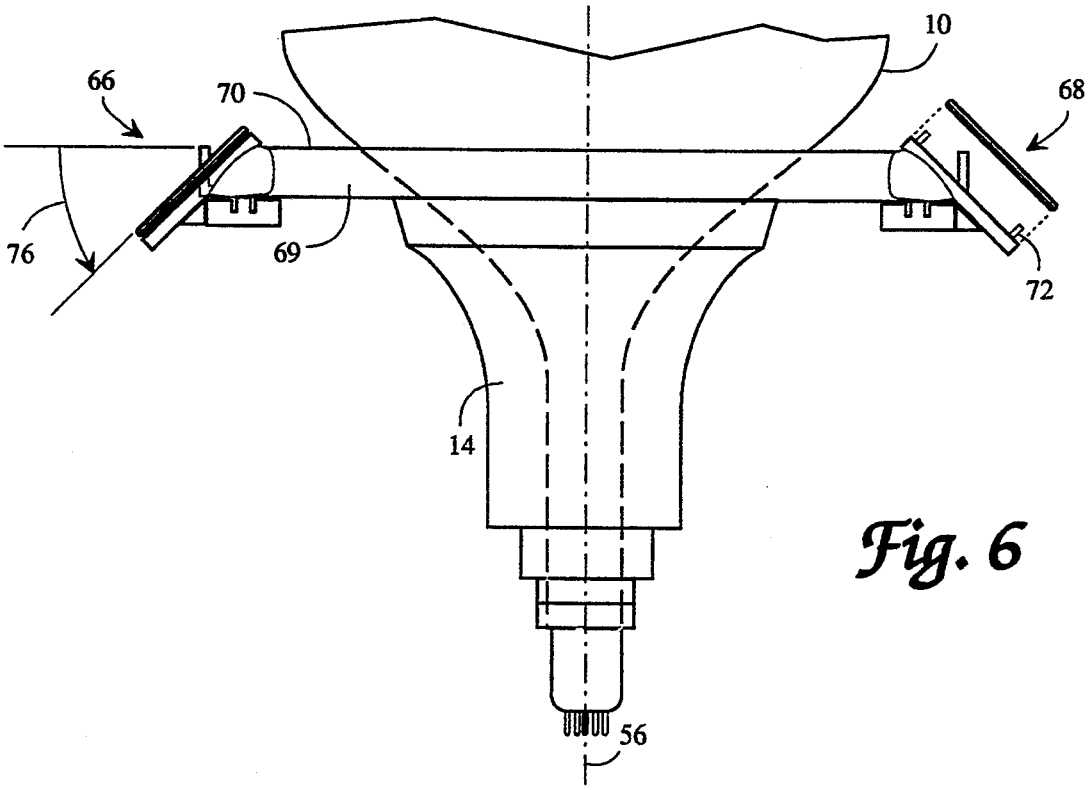
FIG. 6 is side view in elevation of the yoke of FIG. 5.

As indicated in FIG. 6, the magnetic coil assemblies 66 and 68 extend from a yoke support collar 69 preferably at a predetermined angle 76 with respect to the center line 56 of the CRT 10. The angle is established with respect to the plane of the surface 70 of yoke support collar 69, which in turn is perpendicular to the center line 56 of the CRT 10. The angle 76 defined by the coil assemblies 66 and 68 has a significant influence on their effectiveness in suppressing the stray fields represented by loops 22 and 24. The angle 76 may be in the range of 30 degrees to 60 degrees with respect to the plane of surface 70, and is preferably 45 degrees. A determination of the proper angle is made empirically as the degree of angularity depends upon such factors as the strength of the stray magnetic field and its propagation in the area adjacent to the yoke 14 and within the cabinet 12.

The two magnetic coil assemblies 66 and 68 may as well be physically separate from the yoke 14, and suspended by means other than by attachment to the yoke 14.

Figure 7:
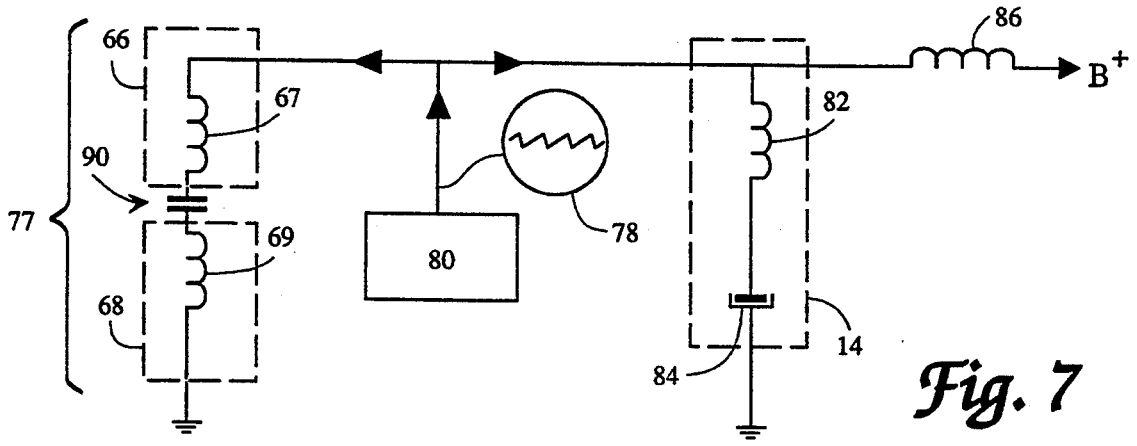
FIG. 7 is a schematic diagram of an embodiment of a circuit of a stray magnetic field suppression system according to the invention, and showing its relationship with a yoke circuit, greatly simplified, and a horizontal oscillator.

As seen in the schematic of FIG. 7, the circuit of yoke 14, represented by the dash line enclosure, is energized by a train of sawtooth waveform pulses 78 from a horizontal oscillator 80. In this highly simplified representation of a yoke circuit, the electrical windings 62 of the yoke 14 are represented symbolically by an inductor 82 which provides for horizontal deflection of the beam. Inductor 82 is in series connection with a capacitor 84 connected to ground. The circuit of yoke 14 essentially comprises a "tank" circuit which is triggered into oscillation by the output of the horizontal oscillator 80. The oscillations of the tank circuit are maintained by a voltage in the range of seventy to one-hundred and fifty from the B+ source indicated. An inductor 86, which by way of example may have an inductance of about six hundred microhenries, isolates the oscillations of the tank circuit from the loading effects of the B+ voltage source.

The stray magnetic field suppression system 77 is composed of the two separate magnetic coil assemblies 66 and 68, each indicated by a dash-line enclosure. The assemblies 66 and 68 have respective wire-wound magnetic coils 67 and 69 therein. The two magnetic coil assemblies are electrically connected in series with a capacitor 90 therebetween, shown as being external to the two assemblies 66 and 68. As indicated, both the circuit of the stray magnetic field suppression system, and the yoke 14, are energized by the pulses 78 from the horizontal oscillator 80. Capacitor 90 may have a value in the range of 0.0068 and 0.027 microfarads, with the exact value depending upon the size and application of the CRT, and the extent of stray magnetic field suppression desired.

Figure 8:
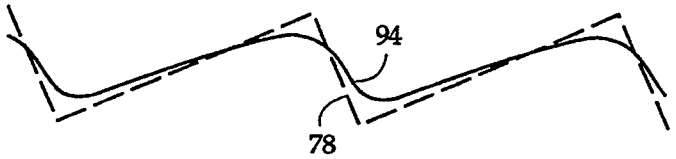
FIG. 8 is a diagram that depicts two pulse waveforms, and indicates the effect of the integration of the horizontal oscillator pulse by the means according to the invention.

Capacitor 90 serves to integrate the sawtooth waveform pulses 78 from the horizontal oscillator 80 to provide a waveshape effective to suppress stray magnetic fields. The effect of the integration resulting from the presence of capacitor 90 is depicted in FIG. 8, which shows the waveforms of two pulses. The integrated pulse waveform is shown as superimposed on the sawtooth waveform pulses 78, indicated by the broken lines, of the horizontal oscillator 80. Rather than having the shape of a sawtooth, the integrated pulse waveform has an S-curve shape.

Figure 9:
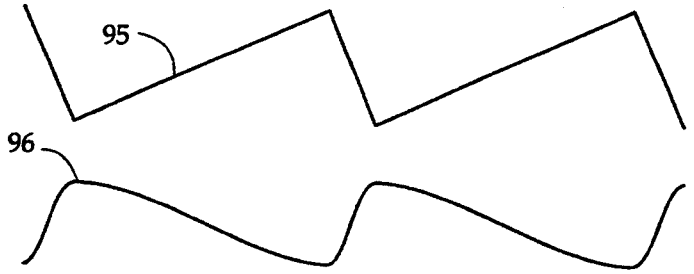
FIG. 9 is a depiction of two waveforms—the waveform of a stray magnetic field, and the waveform of the opposition field as a result of the integration of the horizontal oscillator pulses.

FIG. 9 indicates the waveforms of two magnetic fields, and indicates the effect of the integration of the pulses from the horizontal oscillator 80 in the suppression of the stray magnetic field. Waveform 95 represents the waveform of the stray magnetic field, and waveform 96 represents the waveform of the magnetic field developed according to the invention that opposes and suppresses the stray magnetic field.

Figure 10:
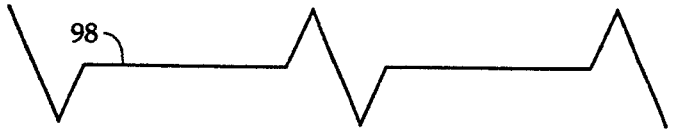
FIG. 10 depicts the residual magnetic field that results from the interaction of the two magnetic waveforms shown by FIG. 9.

FIG. 10 represents the residual magnetic field 98 resulting from the interaction of the waveform 95 of the stray magnetic field, and the waveform 96 that opposes and suppresses the stray magnetic field.

Figure 11:
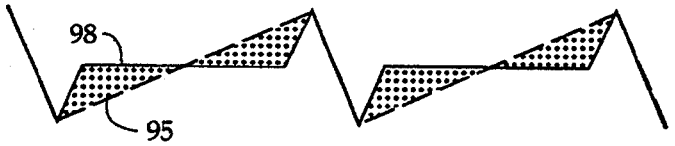
FIG. 11 depicts schematically the extent of the reduction in rms value of the stray magnetic field as a result of the interaction of the two magnetic waveforms of FIG. 9.

The rms value of the stray magnetic field is effectively reduced, as illustrated in FIG. 11 in which the residual magnetic field waveform 98 of FIG. 10 is shown as superimposed on the stray magnetic field waveform 95 of FIG. 9. The cross-shaded areas indicate highly schematically the extent of the reduction in rms value of the stray magnetic field.

As a result, the stray magnetic field suppression system according to the invention effectively suppresses the stray magnetic field of the horizontal deflection coil when the first magnetic coil assembly 66 and second magnetic coil assembly 68 are interposed in the path of the stray magnetic field.

Figure 12:
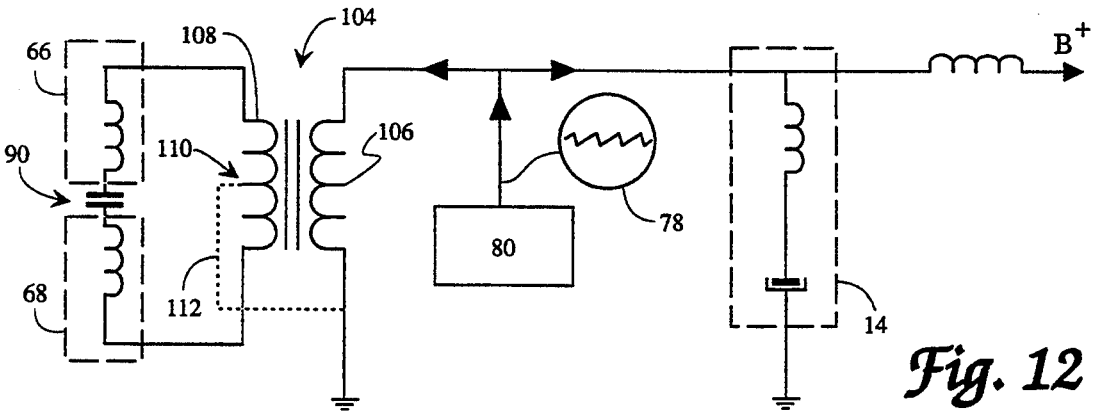
FIG. 12 is a schematic diagram of another embodiment of a circuit used in stray magnetic field suppression system according to the invention.

Another embodiment of a stray magnetic field suppression system according to the invention is depicted in FIG. 12. The circuit of the system is identical to that described in connection with FIG. 7, except that the two magnetic coil assemblies 66 and 68 of the system are energized by the output of an impedance-matching transformer 104. The primary winding 106 of impedance-matching transformer 104 is energized by sawtooth waveform pulses 78 from the horizontal oscillator 80. The secondary winding 108 of impedance-matching transformer 104 is in parallel connection with the two magnetic coil assemblies 66 and 68 that comprise the stray magnetic field suppression system.

While the circuit of the horizontal oscillator in most image display systems can support the additional current load resulting from connection to a magnetic field suppressing system, the circuit normally cannot provide the necessary increase in drive voltage without a major redesign of the circuit. An impedance-matching transformer according to the invention, however, provides the necessary increase (or if desired, a decrease) in drive voltage, depending on whether it is wound as a step-up or step-down transformer. The impedance-matching transformer can also be wound to supply either positive-going or negative-going pulses. As a result, a stray magnetic field suppression system can be readily adapted to any CRT image display by a simple modification in the design of the transformer, and with no modification of the horizontal oscillator or power supply circuits.

Another benefit in the use of the impedance-matching transformer 104 is that, if desired, a center tap 110 on secondary winding 108 can be connected to ground, as indicated by the dotted-line grounding connection 112. As a result of the center-tap connection, the first and second magnetic coil assemblies 66 and 68 are energized with pulses of opposite polarity; that is, and by way of example, the first magnetic coil assembly 66 can be energized by positive-going pulses from the horizontal oscillator 80, and second magnetic coil assembly 68 by negative-going pulses, or vice versa. Applying negative-going and positive-going energizing pulses of equal amplitude to the magnetic coil assemblies 66 and 68 has the effect of cancelling the electric field component that emanates from them.

Figure 13:
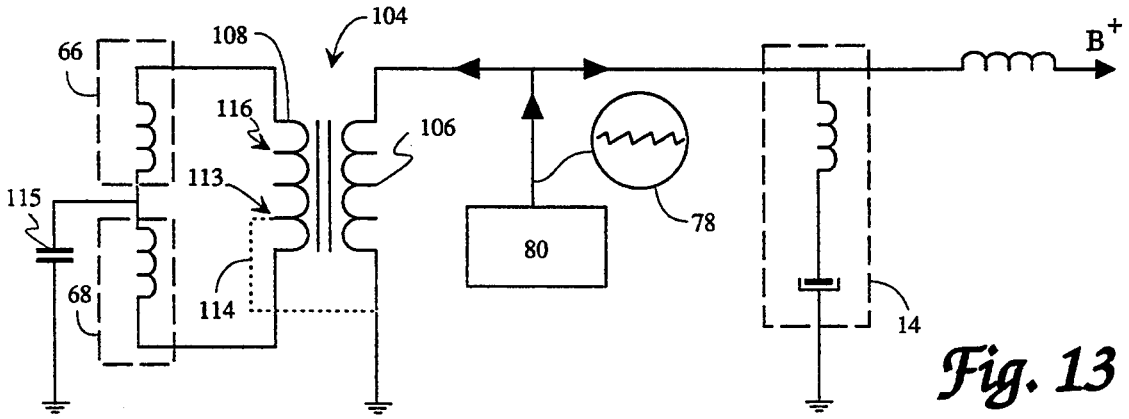
FIG. 13 is a schematic similar to the diagram of FIG. 12 depicting another aspect of the FIG. 12 embodiment.

Another embodiment of the present invention related to the the impedance-matching transformer 104 is depicted in FIG. 13. The secondary winding 108 of impedance-matching transformer 104 is indicated schematically as being tapped off-center at a first off-center tap 113 and connected to ground, as indicated by the dotted-line grounding connection 114. Also, and in lieu of a capacitor being in series-connection with the two magnetic coil assemblies 66 and 68 (as shown by capacitor 90 in FIG. 12), a capacitor 115 is connected from the junction between the magnetic coil assemblies 66 and 68 to ground. This circuit configuration provides pulses of opposite polarity and different amplitude to one of the two magnetic coil assemblies 66 and 68. As a result, an asymmetrical cancelling field is generated to compensate for the influence of incidental magnetic structures within the monitor.

The effect of grounding the first off-center tap 113 by means of grounding connection 114 is a lowering of the amplitude of the pulses directed to magnetic coil assembly 68, and thus a reduction in the cancelling field it generates. If the grounding connection 114 is removed from a first off-center tap 113 and connected to a second off-center tap 116, the amplitude of the pulses directed to magnetic coil assembly 66 will be lowered, resulting in a reduction of the cancelling field magnetic coil assembly 66 generates.

The value of the capacitor 115 is essentially double the value of the capacitor 90 cited heretofore; that is, and by way of example, a value in the range of 0.0136 to 0,054 microfarads.

An impedance-matching step-down transformer for a CRT of fourteen-inch diagonal measure may have, for example, a primary winding of fifty-six turns, and a secondary winding of fifteen turns, using No. twenty-eight polyurethane-nylon coated round copper wire, yellow-card listed. Under test conditions of a one volt, 100 kilohertz, zero milliAmpere signal input, the nominal inductance of the secondary is 76 microHenries.

The core of the impedance-matching transformer 104 is preferably a ferrite, such as the ferrite TDK PC40 supplied by TDK Corporation of America, located in Mt. Prospect, Ill. The recommended core gap is 0.002 inch.

Figure 14:
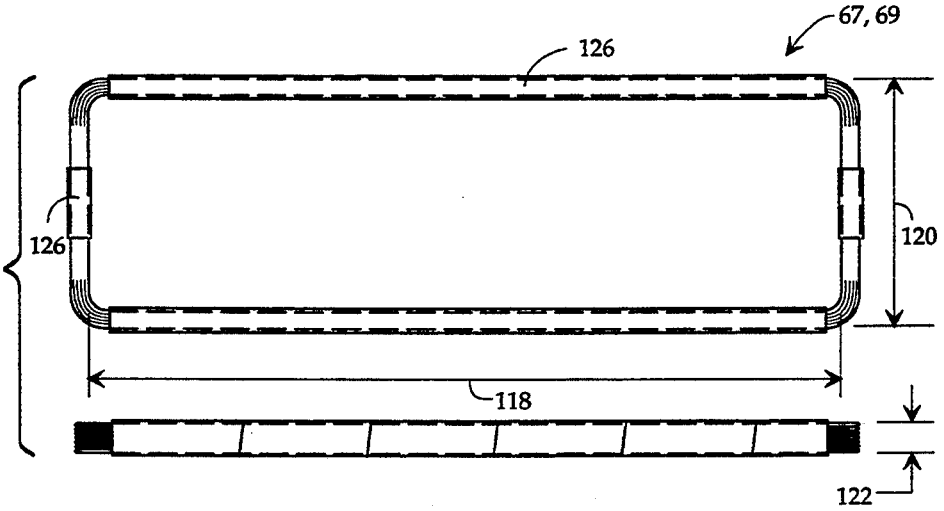
FIG. 14 indicates the design of the wire-wound coil components used in the magnetic coil assemblies that provide for suppression of stray magnetic fields according to the invention.

The general structure of the magnetic coils 67 and 69 that are components of the magnetic coil assemblies 66 and 68 is depicted in FIG. 14. Although the two coils 67 and 69 may be fabricated to differ in magnetic field characteristics, depending upon the application, they are preferably identical physically to facilitate their manufacture and installation. Each of the coils 67 and 69 for use with a CRT having a diagonal measure of fourteen inches may have a length dimension 118 of about four inches, a width dimension 120 of about one inch, and a thickness dimension 122 of about one-eighth of an inch. The dimensions of coils for CRT image displays of greater or lesser diagonal measure will necessarily be different.

The windings of the coils 67 and 69 preferably comprise solderable No. thirty-two gage copper magnet wire. The number of turns may vary from sixty to ninety, with the exact number depending upon the size and application of the CRT. The coils 67 and 69 may be wound on a bobbin 72 (shown by FIG. 6) which comprises an electrically non-conductive plastic. The windings are held in place with tape 126, as indicated. Many possible ways of attachment of the magnetic coil assemblies 66 and 68 to the yoke support collar 69 of the yoke 14 will suggest themselves to those skilled in the art. It is preferable that the angle of the two stray field suppressing assemblies be designed so as to be permanently fixed rather than variable so that adjustment during manufacture will not be necessary.

The inductance of each of the magnetic coil assemblies 66 and 68 is about six hundred microHenries, with the exact inductance again determined by the size, type and application of the CRT with which the stray magnetic field suppression system is used.

Figure 3:
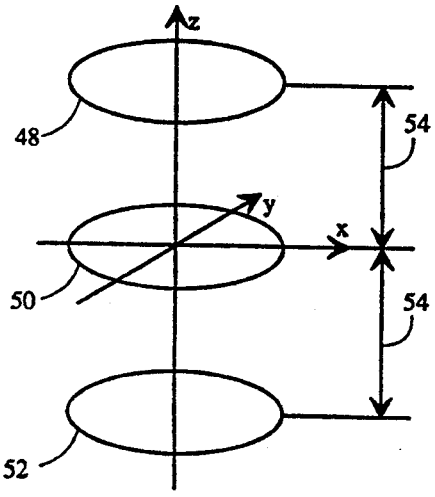
FIG. 3 is a schematic depiction of the three planes in which the strength of a stray magnetic field is measured relative to a CRT image display terminal.
Figure 4:
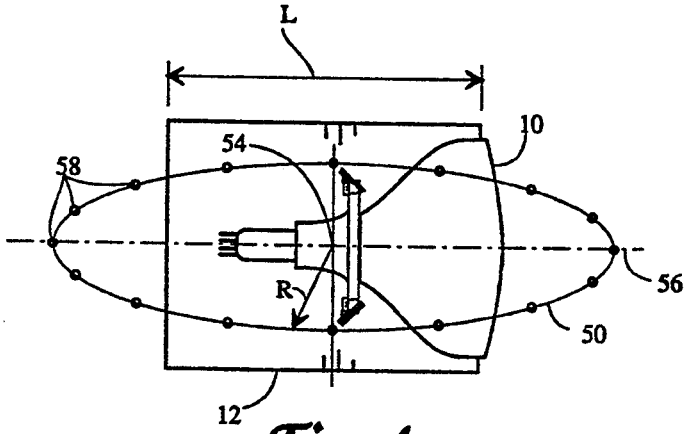
FIG. 4 is a schematic view that depicts the points of measurement of a stray magnetic field on the three planes indicated in FIG. 3.

As measured according to the method described in connection with FIGS. 3 and 4, the stray magnetic field suppression system according to the invention provides for a suppression of stray fields to a level well below the MPR-2 standard, noted as specifying a maximum of 25 nanoTesla.

While a particular embodiment of the invention has been shown and described, it will be readily apparent to those skilled in the art that changes and modifications may be made in the inventive means without departing from the invention in its broader aspects, and therefore, the aim of the appended claims is to cover all such changes and modifications as fall within the true spirit and scope of the invention.

We claim:

1. For use in a CRT image display, a stray magnetic field suppression system for suppressing a stray magnetic field that emanates from the horizontal deflection coil of a beam-deflecting yoke energized by sawtooth waveform pulses from a horizontal oscillator, comprising:

a) a first magnetic coil assembly and a second magnetic coil assembly electrically connected in series with a capacitor therebetween, and energized by the sawtooth waveform pulses of the horizontal oscillator, the first and second magnetic coil assemblies being in parallel with the yoke;

b) the capacitor serving to integrate the sawtooth waveform pulses into a waveshape effective in suppressing stray magnetic fields;

whereby the stray magnetic field suppression system effectively suppresses the stray magnetic field of the horizontal deflection coil when the first magnetic coil assembly and the second magnetic coil assembly are interposed in the path of the stray magnetic field on opposite sides of the yoke.

2. The stray magnetic field suppression system according to claim 1 wherein the first magnetic coil assembly and the second magnetic coil assembly are affixed to the yoke.

3. The stray magnetic field suppression system according to claim 2 wherein the first magnetic coil assembly and the second magnetic coil assembly are affixed to the yoke at an angle in the range of 30 degrees to 60 degrees with respect to the center line of the CRT.

4. The stray magnetic field suppression system according to claim 1 wherein the first magnetic coil assembly and the second magnetic coil assembly are physically separate from the yoke.

5. The stray magnetic field suppression system according to claim 1 wherein the system is energized by the output of an impedance-matching transformer whose primary winding is energized by the sawtooth waveform pulses of the horizontal oscillator, and whose secondary winding is in parallel with the stray magnetic field suppression system.

6. The stray magnetic field suppression system according to claim 5 wherein the secondary of the impedance-matching transformer is center-tapped so that the first magnetic coil assembly and the second magnetic coil assembly are energized with pulses of equal amplitude but opposite polarity.

7. The stray magnetic field suppression system according to claim 5 wherein the secondary of the impedance-matching transformer is tapped off-center to provide pulses of opposite polarity and of different amplitude to the magnetic coil assemblies.

8. For use in a CRT image display, a stray magnetic field suppression system for suppressing a stray magnetic field that emanates from the horizontal deflection coil of a beam-deflecting yoke energized by sawtooth waveform pulses from a horizontal oscillator, comprising:

a) a first magnetic coil assembly and a second magnetic coil assembly connected in series with a capacitor therebetween, and energized by the sawtooth waveform pulses of the horizontal oscillator;

b) the capacitor serving to integrate the sawtooth waveform pulses, enabling the suppression system to more effectively suppress stray fields; and c) an impedance-matching transformer whose primary winding is energized by the sawtooth waveform pulses of the horizontal oscillator and whose secondary winding is in parallel with the series-connected first magnetic coil assembly and second magnetic coil assembly;

whereby the stray magnetic field suppression system, when energized by the impedance-matching transformer, effectively suppresses the stray magnetic field of the horizontal deflection coil when the first magnetic coil assembly and the second magnetic coil assembly of the system are interposed in the path of the stray magnetic field on opposite sides of the yoke.

9. The stray magnetic field suppression system according to claim 8 wherein the first magnetic coil assembly and the second magnetic coil assembly are affixed to the yoke.

10. The stray magnetic field suppression system according to claim 9 wherein the first magnetic coil assembly and the second magnetic coil assembly are affixed to the yoke at an angle in the range of 30 degrees to 60 degrees with respect to the center line of the CRT.

11. The stray magnetic field suppression system according to claim 8 wherein the first magnetic coil assembly and the second magnetic coil assembly are physically separate from the yoke.

12. The stray magnetic field suppression system according to claim 8 wherein the secondary of the impedance-matching transformer is center-tapped to ground so that the first magnetic coil assembly and the second magnetic coil assembly are energized with pulses of opposite polarity.

13. For use in a CRT image display, a stray magnetic field suppression system for suppressing a stray magnetic field that emanates from the horizontal deflection coil of a beam-deflecting yoke energized by sawtooth waveform pulses from a horizontal oscillator, comprising:

a) a first magnetic coil assembly and a second magnetic coil assembly interconnected and energized by the sawtooth waveform pulses;

b) a capacitor connected between the junction of the first magnetic coil assembly and the second magnetic coil assembly and ground;

c) the capacitor serving to integrate the sawtooth waveform pulses, enabling the suppression system to more effectively suppress stray fields;

d) an impedance-matching transformer whose primary winding is energized by the sawtooth waveform pulses of the horizontal oscillator and whose secondary winding is in parallel with the interconnected first magnetic coil assembly and second magnetic coil assembly; and e) the transformer being off-center tapped to ground to provide pulses of opposite polarity and of different amplitude to the two magnetic coil assemblies;

whereby the stray magnetic field suppression system, when energized by the impedance-matching transformer, effectively suppresses the stray magnetic field of the horizontal deflection coil when the first magnetic coil assembly and the second magnetic coil assembly of the system are interposed in the path of the stray magnetic field on opposite sides of the yoke.

* * * * *